United States Patent [19]

Preus

[11] 4,104,884

[45] Aug. 8, 1978

[54] INFLATABLE BARRIER

[76] Inventor: Paul Preus, Smith Rd., Toms River, N.J. 08753

[21] Appl. No.: 786,993

[22] Filed: Apr. 13, 1977

Related U.S. Application Data

[63] Continuation of Ser. No. 676,795, Apr. 14, 1976, abandoned.

[51] Int. Cl.[2] ..... E02B 15/04

[52] U.S. Cl. ..... 61/1 F; 210/DIG. 25

[58] Field of Search ..... 61/1 F, 4, 5; 210/DIG. 25, 242

[56] References Cited

U.S. PATENT DOCUMENTS

| | | | |
|---|---|---|---|
| 3,662,891 | 5/1972 | Headrick | 61/1 F X |
| 3,685,297 | 8/1972 | Juodis et al. | 61/1 F |
| 3,703,811 | 11/1972 | Smith | 61/1 F |
| 3,751,925 | 8/1973 | Thurman | 61/1 F |
| 3,779,020 | 12/1973 | Muramatsu et al. | 61/1 F |
| 3,859,796 | 1/1975 | Benson | 61/1 F |

*Primary Examiner*—Dennis L. Taylor
*Attorney, Agent, or Firm*—Harold L. Stowell

[57] ABSTRACT

A barrier for water carried pollutants comprises a series of end to end connectable boom sections with each section comprising a flexible tubular sleeve and a depending skirt. The tubular sleeves contain a plurality of inflatable tubular chambers extending substantially the entire length of the flexible sleeve. Each of the tubular chambers terminating at least at one end of the sleeve in inflation valve means. In a preferred form of the invention there are seven tubular chambers carried in each tubular sleeve.

3 Claims, 7 Drawing Figures

INFLATABLE BARRIER

This is a continuation of application Ser. No. 676,795, filed Apr. 14, 1976, now abandoned.

CROSS-REFERENCES TO RELATED PATENTS

Related subject matter is disclosed and claimed in my U.S. Pat. Nos. 3,849,989 issued Nov. 26, 1974 and 3,667,235 issued June 6, 1972.

BACKGROUND OF THE INVENTION

Field of the Invention

Floating barriers, known generally as oil booms, have been found to have great utility in containing and controlling oil slicks on bodies of water. The barriers usually include flotation elements having a depending liquid impervious skirt which, when deployed around or in a controlling position relative to oil floating on water, provide means to contain or prevent the oil from spreading or moving into areas protected by the barrier.

Present art barriers generally utilize a solid material as the flotation medium since gas inflatable flotation elements are susceptible to puncture and/or deflation in the environment to which the barriers are normally subjected. However, solid material containing booms have drawbacks in that they require a great amount of storage and transportation space and the greater difficulty in manipulating the barrier during deployment, positioning and retrieval. Furthermore, because a solid flotation element will have a larger moment of inertia than an inflated flotation element of equivalent size, the solid floatation element is more resistant to movement and therefore less able to follow wave motion without slop over and, further, due to the lower freeboard of solid floatation elements oil containment is less effective.

SUMMARY OF THE INVENTION

This invention is directed to an inflatable barrier for water carried pollutants which avoids the disadvantages of the prior art by providing an elongated flexible tubular sleeve within which are carried a plurality of inflatable tubular flotation chambers which extend substantially the entire length of the flexible sleeve with each of the tubular chambers terminating at least at one end of each of the flexible tubular sleeves in inflation valve means.

In a preferred embodiment of the invention, there are provided seven of the tubular chambers in each tubular sleeve and the assembly includes a depending skirt and an upstanding fin which functions as a spoiler to "kill" aerodynamic lift which has been found to be generated on cylindrical generally lightweight flotation structures.

These and other objects and advantages of the invention will become more apparent to those skilled in the art by reference to the following detailed description when viewed in light of the accompanying drawings.

DETAILED DESCRIPTION OF PREFERRED EMBODIMENTS

Figure 1:
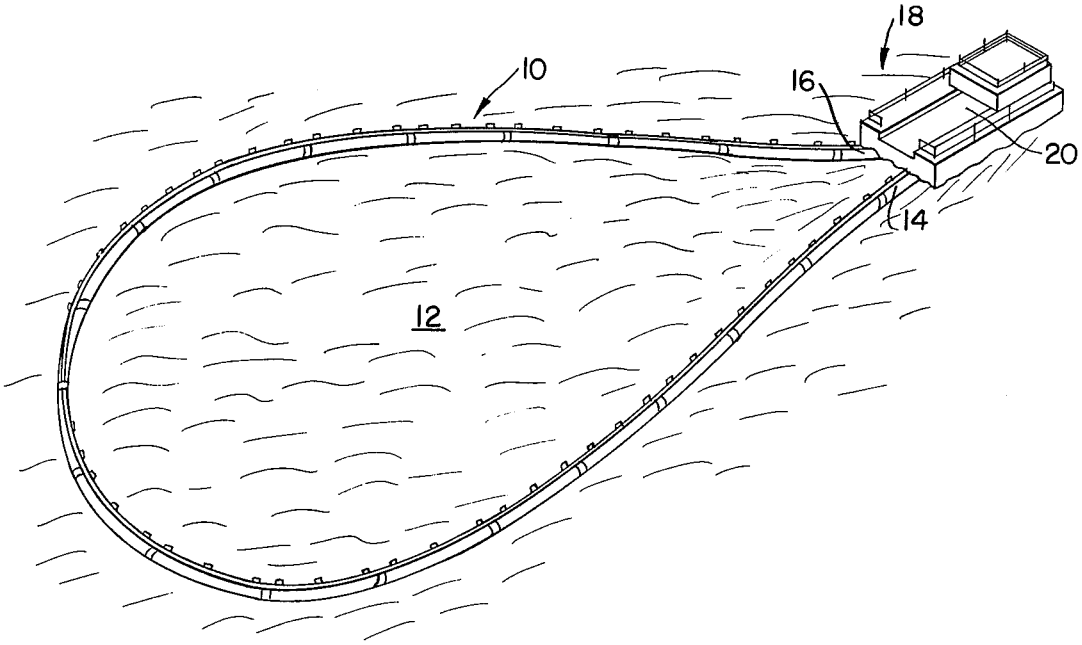
FIG. 1 is a diagrammatic showing of a floatation boom assembly constructed in accordance with the teachings of the present invention.

Referring to the drawing, 10 generally designates an inflatable oil containing boom of the invention which boom surrounds an oil spill or the like 12 floating on the surface of a body of water. In the illustrated form of the invention, the ends 14 and 16 of the boom are shown attached to a vessel 18 which may be of the type having a well 20 to receive oil picked up from the contained area. It will be appreciated, however, that the ends 14 and 16 of the boom 10 could be interconnected as are the other sections forming the boom and anchor chains, cables and the like may be employed to immobilize the boom in the designed location as to be more fully disclosed hereinafter.

Further, the boom may be used to encircle the pollutant then the unit with the enclosed pollutant may be floated or towed to a suitable location for removal of the encircled pollutant.

Figure 2:
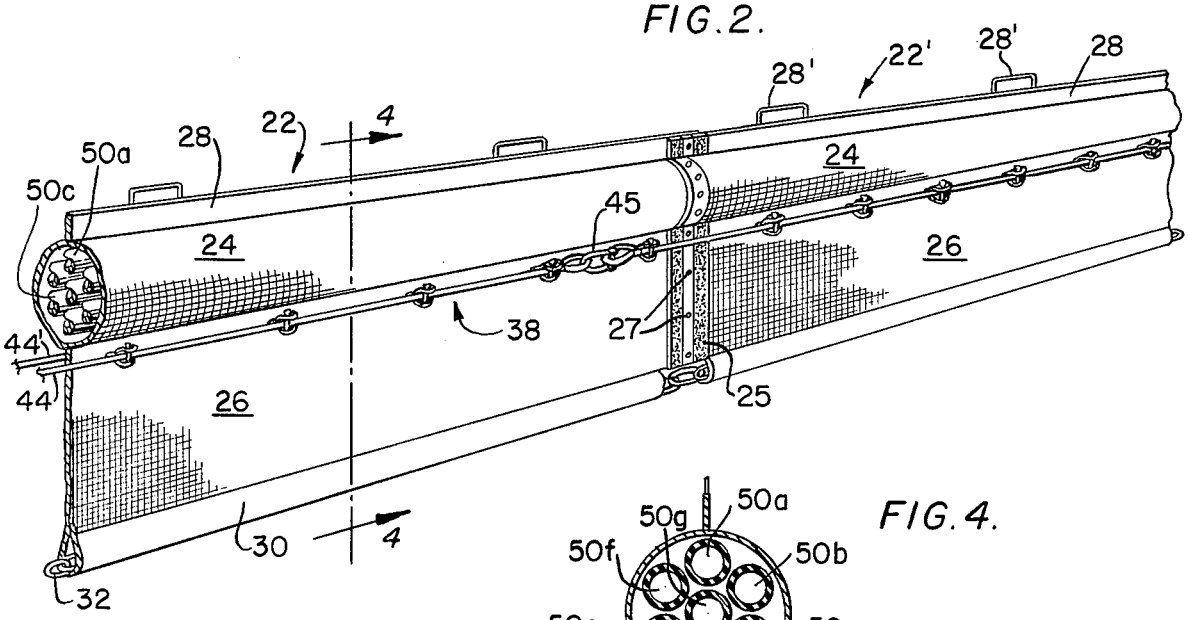
FIG. 2 is an enlarged perspective view of a portion of two boom sections of the structure shown in FIG. 1.
Figure 4:
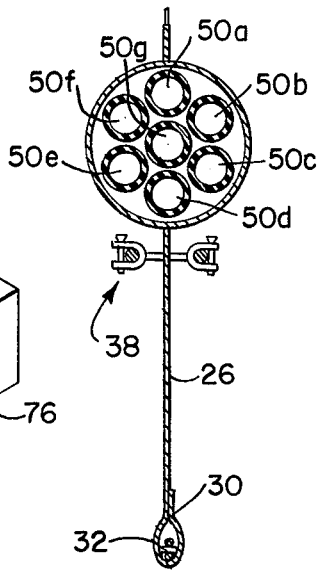
FIG. 4 is a section on line 4—4 of FIG. 2.
Figure 7:
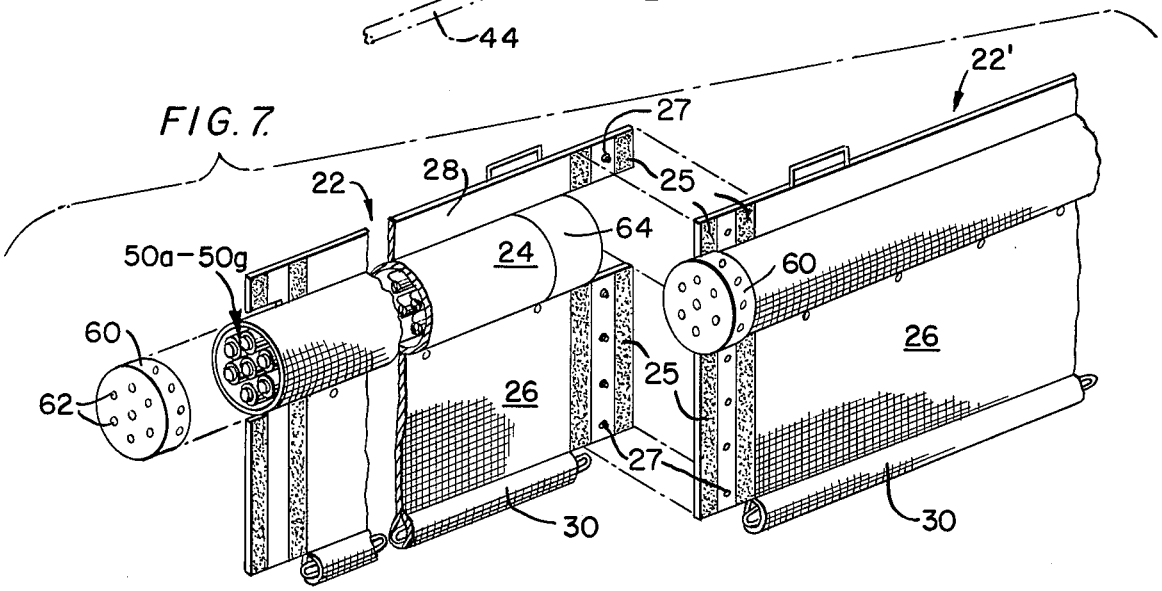
FIG. 7 is an exploded fragmentary perspective view of a typical joint between a pair of boom sections constructed in accordance with the teachings of the present invention.

The boom is made up of a plurality or series of boom sections, two of which are illustrated at 22 and 22' in FIGS. 2 and 7 of the drawing. Each of the boom sections comprises generally flexible water resistant tubular element or sleeve 24, a depending liquid impervious skirt 26 and a projecting fin 28.

Each tubular sleeve portion 24 has a length of, for example, 50 feet and a diameter of, for example, 8 inches. Each boom section may have a length of from 2 feet to 100 feet and diameters in the range of from 6 inches to as much as 36 inches for example. The sleeve is constructed of, for example, nylon reinforced PVC sheet material, nylon reinforced oil resistant rubber fabric and the like. The depending skirt 26 and the fin 28 may be constructed of the same type of material.

As more clearly shown in FIG. 7, the skirt 26 and fin 28 extend beyond the ends of the tubular sections 24 to provide a fluid tight sealing flap between the units. A sealing flap is lapped and jointed to the sealing flap of the next succeeding boom section by means of "Velcro" fastening means 25, snap hooks or sister fasteners, such as shown at 27 or lace type fasteners as desired. Further, it will be noted that spaced along the fin 28 are a plurality of handles 28' which assist in deploying and retrieving the boom sections. The handles 28' are also very useful in storing the boom sections as the handles may be merely slipped over pegs spaced at least a pair of handles distance or multiples thereof. They have also been found to be helpful in cleaning the boom sections prior to reuse as the handles may be hung over books movably positioned above a scrub tank.

The lower end of the skirt is provided with a roll 30 which receives therein a ballast chain 32 which may comprise a one-fourth inch galvanized chain and, when a pair of boom sections are united, a bolt or the like connects the extended links of each adjacent ballast chain. Slightly below the tubular portion 24 are provided a plurality of openings which receive resilient grommets 34 sized to snugly receive the male threaded portion 36 of the cable retaining connectors generally designated 38. The threaded end 36 is received on the opposite side of the skirt 26 in an internally threaded female portion 40. The extended ends of the connectors 38 are furcated as at 42 and 42', which furcations receive a pair of cables 44 and 44', one lying on each side of the entire boom. The cables are maintained in their respective connectors 42 and 42' by locking bolts 46 and 46'.

Any suitable form of cables 44 and 44' or chains can be used in the unit; however, in order to insure the integrity of the boom even in rivers which may contain floating debris such as trees, logs, etc., tensile strengths in the order of from about 4,000 to 80,000 pounds is desirable.

Preferably the cables 44 and 44' are provided in lengths of about 50 feet or so and such lengths are jointed in end to end fastened by suitable cable connectors or furcated connectors such as connectors 38 as shown at 45 in FIG. 2 of the drawing.

Through the use of the connector assemblies 38, one or more sections 22, 22', etc. may be replaced without disturbing the integrity of the boom as more fully described in my copending application Ser. No. 676,794 filed Apr. 14, 1976, now U.S. Pat. No. 3,998,060.

Maintained within each tubular section 24 are a plurality of elongated tubular inflation chambers designated 50*a, b, c, . . . g*. Each of the tubular elongated inflation chambers 50*a–g* has an internal diameter of about 2 inches where the internal diameter of the sleeve 24 is 8 inches.

The two inch diameter chambers are selected as present flexible impervious tube making machinery is available for constructing such inflatable chambers.

Figure 5:
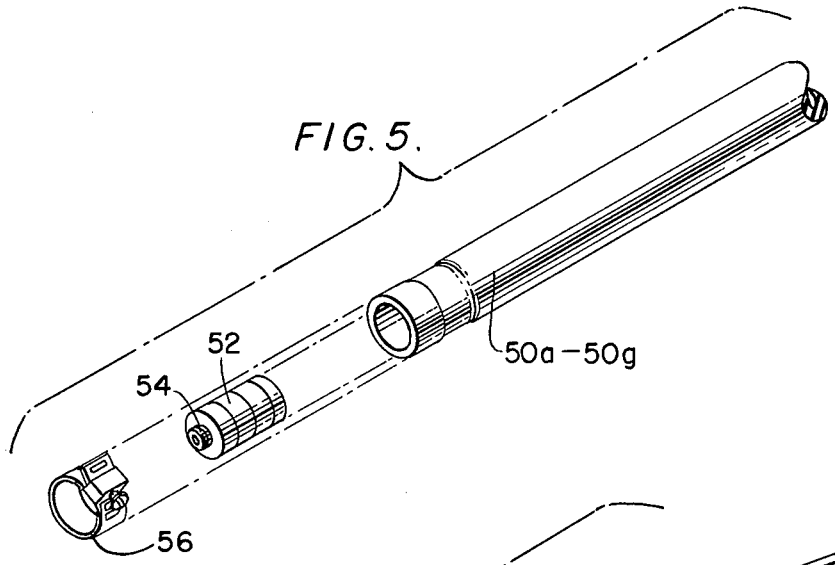
FIG. 5 is an exploded view of the inflation end of one of the tubular inflation chambers for the boom assembly.
Figure 6:
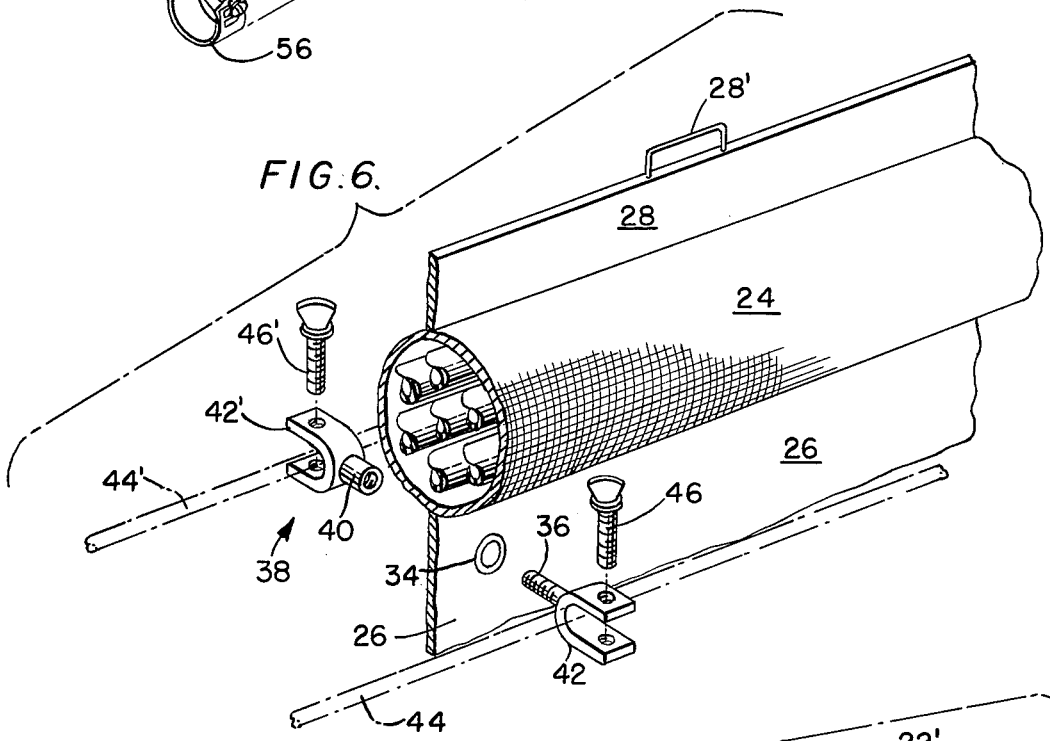
FIG. 6 is an enlarged exploded view of means for attaching an inflated boom section to control wires extending along each side of the boom.

The length of each of the inflatable chambers 50*a–g* is generally the same as the length of the flexible sleeve 24 and/or units having values only at one end. The other end of each of the inflatable chambers 50*a–g* is sealed by clamp means, heat sealing, etc. depending upon the material of construction of the inflatable tubes 50*a–g*, as more clearly shown in FIG. 5, receives a housing 52 provided with an inflator valve mechanism generally designated 54. The valve mechanism may be of the type conventionally employed in the manufacture of inflation valves for inflatable tires for land vehicles.

The valve housing 52 is maintained within each of the tubes 50*a–g* by a conventional hose clamp 56.

While it will be appreciated by those skilled in the art that each of the internally positioned inflation chambers 50*a–g* could have one end connected to a common header provided with a single valve, a leak in any one of the elements 50*a–g* would then cause collapse of the entire boom section. However, with each of the tubular chambers 50*a–g* having its own inlet and outlet valve 54, a leak in any one of the units would not materially affect the function of the particular boom section as the remaining tubular flotation chambers would provide adequate buoyancy for the unit.

It has been found that in units having seven tubular flotation chambers, loss of pressure in as many as three of the chambers will not materially affect the flotation section as the remaining chambers will expand and take up the void, thus maintaining the proper height of the freeboard.

Referring to FIG. 7 of the drawing, end caps 60 are provided for each of the tubular sleeves 24, which end caps are attachable to the end of the sleeve by, for example, snap fasteners in combination with water tight Velcro type fasteners and the end caps 60 which are at the ends of the tubular sleeves adjacent the inflation valves 54, are provided with a plurality of openings fitted with resilient grommets 62 which snugly fit over the extended ends 54 of the inflation valves and normally prevent entry of liquids into the sleeve 24 and about the external surface of the inflation chambers 50*a–g*.

While in the illustrated form of the invention only one end of each boom section is provided with inflation-deflation valve means, it will be recognized that such valve structures may be at both ends.

Figure 3:
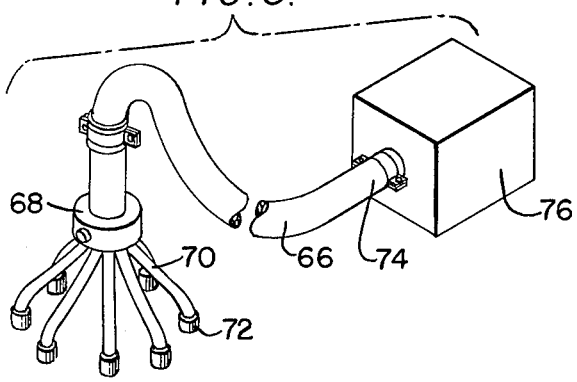
FIG. 3 is a perspective view of apparatus suitable for inflating the inflatable tubular inserts comprising the flotation chambers for the boom assembly.

Referring now to FIG. 3, of the drawing, there is shown a simple but effective manifold arrangement for inflating the boom sections. In FIG. 3, a main gas conduit 66 is connected at one end to a header 68 having seven outlet lines 70 provided with an outlet adapter of the type to mate with the valve structure 54 for each of the elongated flotation chambers. The opposite end 74, of the conduit 66, is connected to a source of pressure gas generally designated 76, which source may be a bank of compressed air bottles, an electric or gasoline driven compressor or, for example, the exhaust outlet or pipe from an automotive vehicle, which has proven to have sufficient pressure to inflate the plural inflatable chambers 50*a–g* sufficiently for construction of the retaining boom.

In use, the segments 22, 22', etc. are normally stored or maintained in a deflated condition and are deployed from its stored configuration and preferably inflated as each boom section is flaked out. Inflation is relatively low in the order of several psi.

The boom sections may be stored either separately to be connected to one another as the boom is paid out or stored in predetermined lengths with the connection between boom sections being made before storage as the use requirements or particular needs dictate.

Further, the boom sections can be stored either in a folded condition or due to the low deflated cross section thereof, on reels or rollers for ready deployment as use may dictate. Further, as hereinbefore set forth, the handles 28' may be used to hang the sections on suitable pegs or hooks.

Throughout the specification and in the drawings, the invention has been described as being deployed with a substantial freeboard; however, it will be recognized that in some cases the barrier may be anchored such that the top of the barrier is below the surface of the water with, for example, the lower edge of the skirt on or adjacent to the bottom of the water body. Further, two or more barrier units may be assembled in stacked superposed relation.

One of the additional advantages of the present form of construction is that, if the skirt and/or tubular sleeve become worn or torn, the hardwear such as the cables 44, 44'; the connectors 38, etc.; chain 32 and inflatable tubes 50*a–g*, etc. may be reused with a new fabric sleeve and shirt.

As disclosed in my application Ser. No. 676,794 Barrier for Water Carried Pollutants filed Apr. 14, 1976, now U.S. Pat. No. 3,998,060, means may be provided for attaching anchor lines to the cables 44 and 44' where anchors are desired. In one form, the anchor line or cable is connected to cable 44 via a clevis type connector similar to connectors 42. Using this type of connector, limited sliding motion is permitted between the anchor line and the cable 44 and, if a cable clamp is used, no sliding motion would exist between the cable 44 and the anchor line.

What has been set forth above is intended as exemplary to enable those skilled in the art to practice the invention and what is new and therefore desired to be protected by Letters Patent of the United States is;

1. A barrier for water carried pollutants comprising a series of end to end connectable boom sections, each boom section comprising a flexible tubular sleeve, seven inflatable tubular chambers removably insertable within said flexible tubular sleeve and extending substantially the entire length of the flexible sleeve, each of said tubular chambers terminating at least at one end of the sleeve in inflation valve means and each of said tubular chambers being closed at the opposite end and when said inflatable chambers are inflated said chambers comprising the primary flotation means for the boom sections, each said boom section being particularly characterized in that one of the seven tubular chambers is positioned about the axis of the tubular sleeve and the other of said tubular chambers are positioned in an annular zone about the said one of the tubular chambers.

2. The invention defined in claim 1 further including means for inflating said inflatable tubular chambers comprising a source of compressed gas, a gas conduit connected at one end to said source of compressed gas, a header at the opposite end of said gas conduit and a plurality of inflating conduits, one for each of said tubular chambers extending from said header.

3. The invention defined in claim 1 wherein said tubular chambers have a diameter of about 2 inches and said flexible tubular sleeve has an internal diameter of about 8 inches.

* * * * *